US005471814A

United States Patent [19]

Ruckdschel

[11] Patent Number: 5,471,814

[45] Date of Patent: Dec. 5, 1995

[54] RING HANDLE APPLICATOR

[76] Inventor: Klaus Ruckdschel, 1556 Woodside Dr., Tacoma, Wash. 98466

[21] Appl. No.: 275,591

[22] Filed: Jul. 15, 1994

[51] Int. Cl.[6] ..... B65B 61/14

[52] U.S. Cl. ..... 53/134.1; 53/295; 53/585; 53/131.3

[58] Field of Search ..... 53/131.3, 134.1, 53/585, 557, 291, 292, 295, 296; 29/235, 282; 156/DIG. 14; 100/9

[56] References Cited

U.S. PATENT DOCUMENTS

| | | | |
|---|---|---|---|
| 2,018,409 | 10/1935 | McCoy | 53/295 |
| 4,144,631 | 3/1979 | Fujio | 53/585 |
| 4,236,305 | 12/1980 | Hetherington et al. | 53/585 |
| 4,845,822 | 7/1989 | Hutson | 29/235 |
| 5,027,489 | 7/1991 | Johnston | 29/282 |

*Primary Examiner*—John Sipos

*Assistant Examiner*—Gene L. Kim

*Attorney, Agent, or Firm*—David L. Tingey

[57] ABSTRACT

A pneumatically-controlled container ring handle applicator—a mechanical device for installing plastic handles around bottle necks by forcibly expanding a plastic ring of the handle as it is urged onto the bottle neck— includes a finger carrier to which carrier is connected a plurality of pivoting fingers that extend from the carrier through slots out of the tube to push a plastic handle ring down a frustum portion of the applicator, expanding the ring as it moves on the increasing frustum diameter until the ring falls off the end of the applicator over a bottle neck placed below the applicator. Movement of the carrier in the finger cylinder is pneumatically-controlled with a piston in a cylindrical tube that moves down a piston cylinder under pneumatic pressure and returns to a rest position under bias of a spring secured in the cylinder under the piston which is compressed as the piston moves down the cylinder. A piston rod connects the piston to the finger carrier.

11 Claims, 2 Drawing Sheets

RING HANDLE APPLICATOR

FIELD OF THE INVENTION

This invention relates to expansion of rings and the like around bottles, and particularly to machines that apply plastic handle rings to bottle necks by expanding the plastic rings and then urging them over a bottle neck lip onto the bottle neck.

BACKGROUND OF THE INVENTION

Several machines have been designed to apply seals and labels around bottles and other containers. One approach is to use shrinkable plastic material around the container, heated to shrink into position. Another is to expand a tubular plastic sleeve as it is placed over the container and then cut and released into position on the container as the material returns to its rest form.

Heat shrinkable materials are not useful as rings that require strength of a handle. Expandable film stock is also not suitable as a handle. A ring with substantial toroidal dimensions is generally required around the container, typically the bottle neck, to support a handle connected to the ring capable of lifting a filled container. But the toroidal ring with more physical strength of material also has more resistance to expansion than a band or label. A mechanical advantage is required in a machine that can reliably apply such rings over bottle necks in a rapid pace of a production line.

SUMMARY OF THE INVENTION

An object of the invention is to provide a simple and reliable applicator apparatus for a production line that expands a ring on a handle and releases the ring over a lip of a bottle and around the bottle neck. The ring, sized smaller than the bottle lip, matches the diameter of the bottle neck. The applicator stores an inventory of the handles with rings, releasing one at at time as required for placement over the bottle.

The objective of the present invention is achieved in a pneumatically-controlled container handle applicator—a mechanical device for installing plastic handles around bottle necks by forcibly expanding a plastic ring of the handle as it is urged onto the bottle neck. Accordingly, the applicator includes a piston in a cylindrical tube moved down the cylinder under pneumatic pressure and returned to a rest position under bias of a spring secured in the cylinder under the piston which is compressed as the piston is moved down the cylinder. A piston rod is connected between the piston and a finger carrier to which carrier is connected a plurality of pivoting fingers that extend from the carrier through slots out of the tube to push a plastic handle ring down a frustum portion of the applicator, expanding the ring as it moves on the increasing frustum diameter until the ring falls off the end of the applicator over a bottle neck placed below the applicator.

DESCRIPTION OF THE PREFERRED EMBODIMENT

Figure 1:
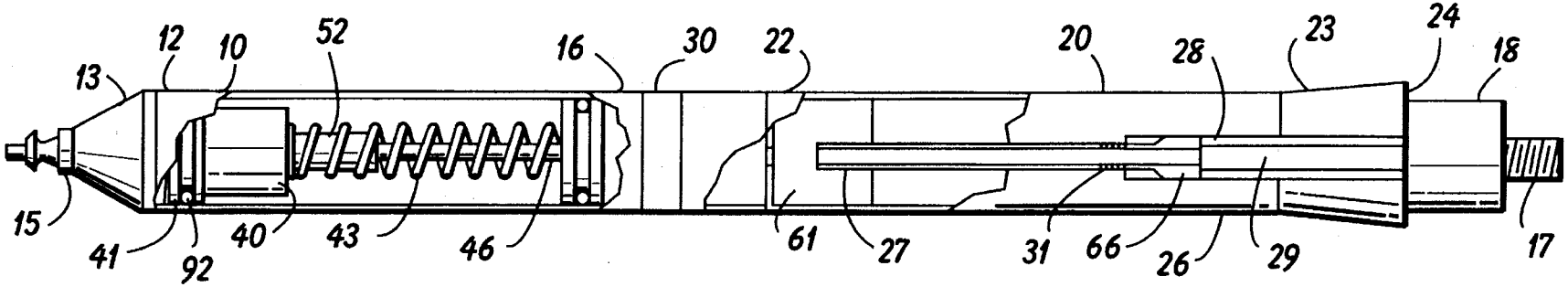
FIG. 1 is a cut-away side view of the ring applicator.
Figure 3:
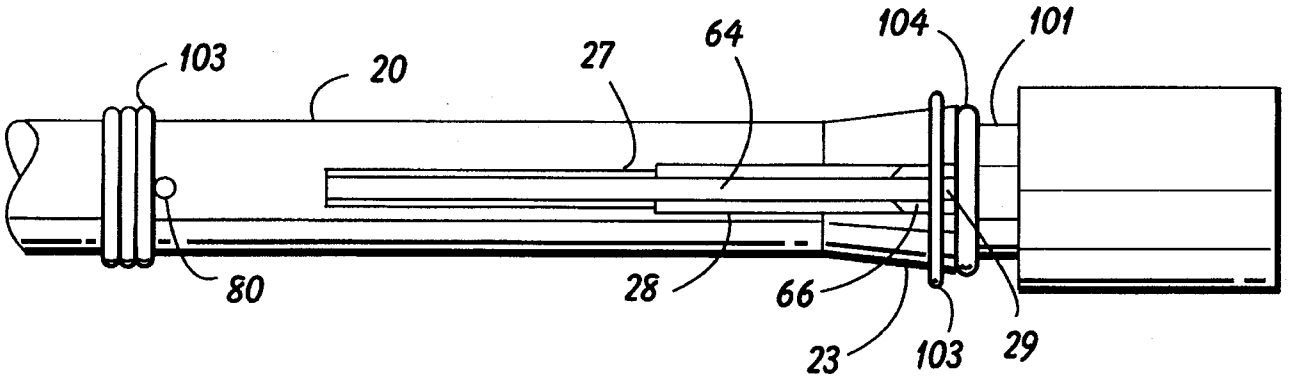
FIG. 3 is a side view of a portion of the ring applicator set on a bottle with a ring pushed by a finger head onto the frustum, ready to fall over the frustum base to the bottle neck below.
Figure 2:
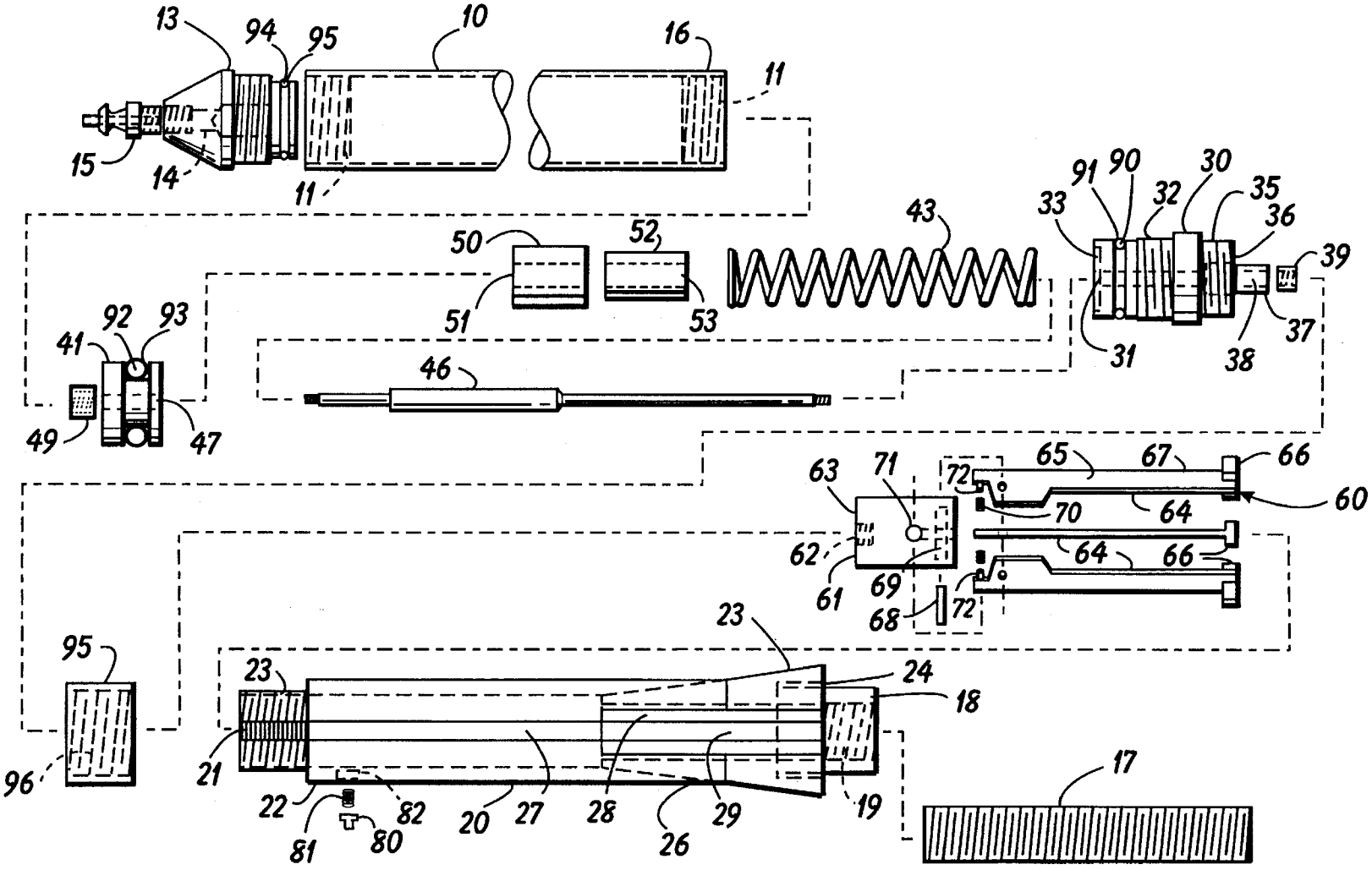
FIG. 2 is an exploded view of the ring applicator.

Referring to the figures, the ring applicator of the present invention comprises a piston cylinder 10 with inner threads 11 and a finger cylinder 20 with inner threads 21 on one end 22 with a member conically expanding from the finger cylinder 20 forming a frustum 23 with a base 24 on a second end 26 of the finger cylinder 20. On one end 12 of the piston cylinder 10 is mounted a cylinder head 13 with a bore 14 passing therethrough. The cylinder head 13 also includes a cylinder head O-ring 94 in a O-ring groove 95 providing a pneumatic sealA pneumatic connector fitting 15 is attached to the cylinder head 13 at the bore 14 providing fluid communication between the piston cylinder and an external source of pressurized air (not shown) attached to the connector fitting 15.

Between and disconnectably uniting the other end 16 of piston cylinder 10 and to finger cylinder 20 is cylinder union member 30. On the frustum base 24 is a bottle guide 18 with a threaded bore 19. A matching threaded rod 17 passes through bottle guide bore 19 into finger cylinder 20.

Cylinder union member 30 has a hole 31 passing therethrough and a coaxial recess 33 for receiving a spring and further comprises a first outer threaded portion 32 for receiving the piston cylinder 10. The union member 30 also includes a first O-ring 90 in a first O-ring groove 91 providing a pneumatic seal. Opposite the first threaded portion 32 is a second outer threaded portion 35 for receiving finger cylinder first end 22 and also having a hollow 36 for receiving rod guide 37 having a hole 38 passing therethrough for receiving and aligning a rod from within the piston cylinder.

Within the piston cylinder 10 is a piston assembly 40 comprising a piston head 41 and a return spring 43. Intermediate piston head 41 is a second O-ring 92 in a second O-ring groove 93 providing a pneumatic seal between the piston head 41 and the piston cylinder 10. A piston rod 46 with threaded ends passes through rod holes 47 in the piston head 41 and the union hole 31, respectively. A piston nut 49 on the rod 46 secures it to the piston head 41. Similarly, a union nut 39 secures the rod 46 to the union 30, but with the threaded rod 46 extending beyond the union nut 39.

Spring block 50 with bore 51 through which the rod 46 passes abuts the piston head opposite the piston nut 49. Spring guide 52 with bore 53 through which the rod 46 also passes abuts the spring block 50 opposite the piston head 41. One spring end fits into the union recess 33, and another fits over spring guide 52 and against spring block 50 such that when the cylinder is charged with compressed air passing through the connector fitting 15 and cylinder head 13, piston head 41 is Urged against bias of the spring 43 as the spring is compressed between the spring block 50 and the cylinder base 42 with the piston rod 46 passing through the cylinder union member 30 into finger cylinder 20. Upon release of pressure, the piston head 41 returns to a rest position under bias of the return spring 43.

Finger assembly 60 slides within finger cylinder 20 and comprises a finger carrier 61 with a threaded bore 62 in a first end 63 into which the piston rod 46 beyond the union nut 39 is threaded. A plurality of elongate fingers 64, typically 3, are connected to the carrier 61. Each finger 64 includes a shaft 65 and a broad finger head 66 larger than the shaft 65 on a first end 67 with the shaft 65 being pivotably connected to the carrier 61 intermediate the shaft length on pivot pin 68 transverse to the shaft 65 in a recess 69 in the carrier 61.

Each finger shaft 65 extends from the carrier 61 out of the finger cylinder 20 through a finger cylinder side slot 27. The side slot 27 is smaller than the finger head 66 and extends longitudinally from the finger cylinder first end 22 to a position intermediate the finger cylinder 20. Each finger shaft 65 passes through a side slot 27 from the finger carrier 61 out of the finger cylinder 20. A finger channel 28 extending from each side slot 27 to the frustum base 24 is sized to slidable fit a finger head 66 and guides the finger head from the side slot 27 to the frustum base 24 with the channel depth at the side slot 27 such that the finger head is contained within the channel 28 with the channel tapering to a near-zero depth at the frustum base 24, the finger head rising out of the channel to engage a ring and pushing the ring as the ring expands on the frustum of increasing diameter. Within the channel 28, the side slot 28 continues as a groove 29 in the channel as a race in which the shaft runs below the finger head.

The finger shaft 65 extends past the pivot pin 68 to a finger spring 70 which is set in a hollow 71 in the carrier 61. A finger post 72 extends from the finger shaft 65 and compresses the finger spring 70 in the carrier hollow 71 as the shaft first end 67 pivots radially away from the carrier 61 as the finger head 66 travels to the frustum base 24, the finger spring bias urging shaft post 72 away from the carrier 61 and the shaft first end 67 toward the carrier 61, thereby maintaining the finger head 66 against the channel 28.

Because the plurality of side slots 27 make the finger cylinder inner threads 21 on a first end 22 unstable on the union 30, first end 22 also has outer threads 23. Cylindrical union stabilizer 95 with inner threads 96 matching first end outer threads 23 is tightened over the outer threads 23 after the finger assembly 60 is installed in the finger cylinder 20 which in turn is threaded onto the union 30.

Threaded rod 17 passing through the bottle guide 18 is adjusted in the threaded bottle guide bore 19 such that the finger carrier 61 impacts on the threaded rod 17 thereby serving as a finger carrier and piston movement limiter.

Plastic handles for installation around a bottle neck 101 include a neck ring 103 sized to fit snugly around the bottle neck 101. The handle then extends from the ring 103. In use, a plurality of handle rings 103 are placed over the piston cylinder 10. One or more spring-biased detents 80 moving against detent springs 81 in respective detent hollows 82 circumferential on the finger cylinder 20 intermediate its length support the handle rings 103 in a stack on the cylinder. Gently urging a handle ring 103 past the detents 80 allows a ring 103 to fall to the frustum 21, the rings 103 sized such that they fall below finger heads 66 resting within the finger channels 27. When the finger heads 66 move out of the channels 27, impelled by the carrier 61 which in turn is moved by the pneumatically-controlled piston 41, and down the frustum 21, the finger heads 66 push the plastic ring 103 down over the frustum surface of increasing diameter, expanding the plastic ring 103 until the ring is pushed over the end of the frustum 21 with downward momentum. When the applicator bottle guide 18 is placed in a bottle neck 101, the handle ring 103 with downward momentum falls past a bottle neck lip 104 before collapsing to its unexpanded radius onto the bottle neck 101. In an alternative embodiment, the frustum base 22 is provided with a recess 28 around the bottle guide sized such that the bottle neck lip 104 fits in the recess 28 with only the bottle neck beyond the base 22, in which case, the ring 103 fall directly to the neck 101 with no regard to momentum of the ring as it is discharged from the applicator.

Having described the invention, what is claimed is

1. A ring applicator for applying a plastic handle ring on a bottle neck over a bottle neck lip by temporarily expanding the ring as it is applied, comprising a finger cylinder with longitudinal slide slots intermediate its length, a conical member expanding from the finger cylinder forming a frustum on the cylinder with a frustum base, the cylinder sized to the inner diameter of the ring such that the ring slides over the cylinder and onto the frustum, and further having a longitudinal finger channel extending from each side slot to the frustum base, a plurality of fingers each including a finger shaft moving in a side slot and a finger head on each shaft slidably moving from within the finger channel on the cylinder and the frustum circumference out of the channel to engage a ring such that the finger head pushes the ring over the frustum surface of increasing diameter until the ring falls over the frustum base, the finger head rising from a channel depth at the side slot such that the finger head is contained within the channel with the channel tapering to near-zero depth at the frustum base, the cylinder, fingers and frustum comprising a piston cylinder assembly, means to impel the fingers in the channels, and means to withdraw the fingers with finger heads into the channel.

2. The ring applicator of claim 1 in which the means to impel the fingers in the channels comprises a finger carrier in the cylinder with each finger shaft pivotably mounted to the finger carrier about its circumference with each shaft extending from the carrier through a cylinder side slot to the shaft head in the cylinder channel, and primary mover means for slidably moving the finger carrier longitudinally in the cylinder.

3. The ring applicator of claim 2 in which primary mover means for slidably moving the finger carrier longitudinally in the cylinder includes a piston and piston cylinder assembly comprising a piston cylinder connected to the finger cylinder, a piston sliding in the piston cylinder, a cylinder head mounted on the piston cylinder with a threaded bore in the head providing fluid communication to the cylinder for charging the cylinder with compressed air thereby causing the piston to move in the cylinder, a piston rod connected between the piston and the finger carrier, and means to return the piston and finger carrier to a rest position.

4. The ring applicator of claim 3 in which the means to return the piston and finger carrier to a rest position comprises a union connecting the piston and finger cylinder assembly to the piston cylinder assembly, with the piston rod passing between the assemblies through a hole in the union, and a return spring between the piston and the union such that when compressed air is discharged through the connector fitting into the finger cylinder, the piston head is urged against bias of the return spring as the spring is compressed between the spring block and the cylinder base with the piston rod passing through the union into the piston cylinder assembly such that upon release of pressure, the piston and finger carrier return to a rest position under bias of the return spring.

5. The ring applicator of claim 1 further comprising a frustum with a threaded hole its base and a matching threaded rod passing through the hole into the piston cylinder assembly such that the finger guide under influence of the primary mover impacts on the threaded rod thereby limiting finger guide travel within the cylinder.

6. The ring applicator of claim 2 further comprising a bottle guide on the frustum base for guiding the ring applicator to a bottle neck with a lip over which a ring is to be installed such that when the applicator bottle guide is placed in a bottle neck with the bottle lip at the frustum base, a ring with momentum from influence of the finger heads is pushed past the frustum base and falls past the bottle neck lip before collapsing to a ring unexpanded radius onto the bottle neck.

7. The ring applicator of claim of claim 1 in which the the side slot continues as a groove in the channel as a race in which the finger shaft runs.

8. The ring applicator of claim 1 further comprising one or more circumferential spring-biased detents on the finger cylinder intermediate its length supporting the handle rings in a stack on the cylinder such that gently urging a handle ring past the detents allows a ring to fall to the frustum.

9. The ring applicator of claim 2 further comprising finger shafts with pivot pin holes intermediate the shaft, a pivot pins for each finger shaft in the finger guide passing through the shaft pivot pin holes, in the finger guide, finger spring hollows for each shaft, a finger spring in each hollow, and a shaft post extending from the shaft into a hollow against a finger spring, compressing the spring as the shaft pivots radially away from the carrier as the finger head travels to the frustum base, the finger spring urging the shaft post away from the carrier and the shaft head toward the finger channel, thereby maintaining the finger head against the channel.

10. The ring applicator of claim 1 in which the frustum has a recess around the bottle guide sized such that the bottle neck lip fits in the recess with only the bottle neck beyond the base.

11. The ring applicator claim 1 further comprising one or more spring-biased detents intermediate the piston cylinder length to support the handle rings in a stack on the cylinder, each detent including a piston cylinder with a detent hollow circumferential on the piston cylinder, a detent spring in respective detent hollows, and a detent post contrained in the detent hollow over the detent spring and moving against the detent spring when pushed.

* * * * *

UNITED STATES PATENT AND TRADEMARK OFFICE

CERTIFICATE OF CORRECTION

PATENT NO. : 5,471,814

DATED : December 5, 1995

INVENTOR(S) : Klaus Ruckdeschel

It is certified that error appears in the above-indentified patent and that said Letters Patent is hereby corrected as shown below:

On the Title page, item [76] Inventor's name should be changed to read --Klaus Ruckdeschel.

Signed and Sealed this

Ninth Day of July, 1996

*Attest:*

Bruce Lehman

BRUCE LEHMAN

*Attesting Officer*

*Commissioner of Patents and Trademarks*